US007118172B1

(12) United States Patent
Pattison-Sheets

(10) Patent No.: US 7,118,172 B1
(45) Date of Patent: Oct. 10, 2006

(54) BACKPACK CHAIR

(76) Inventor: Mari Pattison-Sheets, P.O. Box 947, Kula, HI (US) 96790

( * ) Notice: Subject to any disclaimer, the term of this patent is extended or adjusted under 35 U.S.C. 154(b) by 0 days.

(21) Appl. No.: 11/010,065

(22) Filed: Dec. 10, 2004

(51) Int. Cl.
*A47C 13/00* (2006.01)
*A47C 7/66* (2006.01)
*A47C 7/62* (2006.01)
*A45F 4/02* (2006.01)

(52) U.S. Cl. ..... 297/129; 297/184.1; 297/184.11; 297/184.15; 224/155

(58) Field of Classification Search ..... 297/129, 297/184.1, 184.11, 184.15; 224/155
See application file for complete search history.

(56) References Cited

U.S. PATENT DOCUMENTS 33,398 A * 10/1861 Miller ..... 297/129 X
168,402 A * 10/1875 Laumonier ..... 297/129 X
655,593 A * 8/1900 Webb ..... 297/129
1,039,078 A * 9/1912 Arnold ..... 297/129 X
2,843,185 A * 7/1958 Clem et al. ..... 297/129 X
4,201,416 A 5/1980 Vanderminden ..... 297/184.15
4,487,345 A 12/1984 Pierce et al. ..... 224/155
4,676,548 A * 6/1987 Bradbury ..... 297/129
4,687,248 A * 8/1987 Ross et al. ..... 297/129
4,955,517 A * 9/1990 Maresca ..... 224/155
5,016,792 A * 5/1991 Jay ..... 224/155
5,087,095 A * 2/1992 McFate ..... 297/129
5,139,308 A * 8/1992 Ziman ..... 297/129 X
5,303,975 A * 4/1994 Asato ..... 297/129
5,318,342 A 6/1994 Hale ..... 297/129
5,350,215 A * 9/1994 DeMars ..... 297/129 X
5,409,291 A * 4/1995 Lamb et al. ..... 297/129
5,499,760 A * 3/1996 Pielocik ..... 224/155
5,527,088 A * 6/1996 MacLean ..... 297/129
5,536,064 A * 7/1996 MacLean ..... 297/129
5,538,318 A * 7/1996 MacLean ..... 297/129
5,588,570 A * 12/1996 Zirbel ..... 224/155
5,588,696 A * 12/1996 Jay et al. ..... 297/129
5,626,271 A * 5/1997 Messey et al. ..... 297/129 X
5,628,437 A * 5/1997 Kober ..... 224/155
5,779,112 A * 7/1998 Krulik ..... 224/155
5,927,798 A * 7/1999 Ahn ..... 297/129
5,951,103 A * 9/1999 Barnhill ..... 297/184.15 X
5,957,349 A * 9/1999 Krulik ..... 224/155
5,988,737 A * 11/1999 Tomaiuolo ..... 297/129
6,048,023 A * 4/2000 Lampton ..... 297/129
6,056,172 A 5/2000 Welsh ..... 297/129 X (Continued)

FOREIGN PATENT DOCUMENTS

DE 3541394 A1 * 9/1986 ..... 297/129

(Continued)

*Primary Examiner*—Rodney B. White
(74) *Attorney, Agent, or Firm*—Schmeiser, Olsen & Watts, LLP

(57) ABSTRACT

A backpack chair which allows the user to carry a chair on their back while still having the packing ability of a backpack. Embodiments of the backpack chair include a collapsible chair frame which opens into a chair and collapses into a backpack frame. A seat panel attached to the collapsible chair frame provides support for the user when the frame is opened into a chair. A pack container is attached to the seat panel and a flap is also attached in order to close the pack container and provide shade for the user when the collapsible chair frame is being used as a chair. The collapsible chair frame is also configured to form a stand for the backpack in order to provide ease of packing and unpacking the pack container. Shoulder straps are attached directly opposite the pack container on the collapsed collapsible chair frame.

19 Claims, 3 Drawing Sheets

U.S. PATENT DOCUMENTS

| | | | | |
|---|---|---|---|---|
| 6,145,716 | A * | 11/2000 | Caicedo | 224/155 |
| 6,547,324 | B1 * | 4/2003 | Ammann, Jr. | 297/129 |
| 6,739,652 | B1 * | 5/2004 | Welsh | 297/129 |
| 2004/0051351 | A1 * | 3/2004 | Gallegos | 297/184.13 |
| 2005/0099039 | A1 * | 5/2005 | Rhee | 297/129 |

FOREIGN PATENT DOCUMENTS

| | | | | |
|---|---|---|---|---|
| EP | 569317 | A1 * | 11/1993 | 297/16.2 |
| GB | 2161760 | A * | 1/1986 | 297/129 |
| GB | 2275868 | A * | 9/1994 | 297/184.11 |

* cited by examiner

BACKPACK CHAIR

BACKGROUND OF THE INVENTION

1. Technical Field

This invention generally relates to improvements in folding chairs. More particularly, the invention relates to configurations for backpack chairs which provide added convenience for the user.

2. Background Art

Backpacks and folding chairs are extremely compatible. Generally, when one is carrying a folding chair which is often used for various outdoor activities, they are also carrying other items. For example, someone taking a folding chair to a beach would generally be carrying beach towels, sun screen, a book, and other common beach items. Trying to carry a folding chair and these other items separately can be extremely burdensome. Accordingly, having a folding chair and backpack combination makes it much more convenient for the user to carry all their equipment.

While the combination of a folding chair and a backpack provide some easily recognizable advantages, there are other improvements which can be made to further benefit the user.

Most backpacks have no frame. They consist of little more than a container of pliant material to which shoulder straps are affixed. Day packs, knapsacks, book bags, bike bags, and the like, are examples.

On the other hand, general purpose backpacks which are capable of use in carrying heavy, bulky loads have a frame shaped to permit distribution of the load. Such frames usually comprise side bars interconnected at their upper and lower ends by cross-members to form a generally rectangular structure. The pack is made of pliant material and is suspended from the upper cross-member or the side bars or both cross-member and side bars.

An important feature of such a structure is that the element that rests against the wearer's back is separated physically from the walls of the pack container. The contents of the pack container are likely to cause depressions and bulges and protrusions in its forward side that would cause considerable discomfort if permitted to engage the pack carrier's back. Instead, a back rest is stretched taut across the side rails of the backpack frame in a region of the frame at which it, rather than the pack container, will rest upon the wearer's back. The shoulder straps of the conventional, framed backpack extend from an upper crossbar to respectively associated points on the side bars of the frame.

The result of the assemblage of back rest, shoulder straps, frame and pack container is an apparatus which is efficient for the performance of its primary task. A conditioned wearer can use it to carry heavy loads for long periods over difficult terrain. However, once removed from the wearer's back, it is awkward, will not readily stand with the pack container upright, and is thoroughly inconvenient and when empty has no use.

U.S. Pat. No. 4,487,345 introduced the concept of incorporating a folding chair into a backpack such as those described above. The backpack chair, in a collapsed position, includes straps that extend over the shoulders and under the arms of a user so that the user may carry the chair on his or her back. These chairs are made of wood with diagonally extending legs that form an X-shape coupled to one another through cross-members. Additional wood slats form a seat frame and a back frame, with the seat and back frames pivotally coupled to one another through a cross-member. A canvas panel extends across the seat frame to form a seat for the user. A similar panel extends across the back frame to provide a seat back for the user. A pack container is also attached to the folding chair. This invention, however, requires that the chair be fully open in order to support the pack container in an upright position. This makes it awkward to pack or unpack the pack container unless there is plenty of room to fully open the chair.

What is needed, therefore, is a backpack chair that provides support for the pack container in an upright position even if the chair is not fully open, while still retaining the qualities of a good backpack. In addition, it is also beneficial to provide a folding chair and backpack combined and modified to provide other conveniences for the user.

DISCLOSURE OF THE INVENTION

The present invention relates to backpack chairs in general. Specifically, this invention relates to configurations for backpack chairs which provide added convenience for the user. Various novel aspects of the invention disclosed herein may be used in conjunction, or separately and those of ordinary skill in the art will readily understand how to apply the many novel aspects of the invention to other applications from the disclosure provided.

Embodiments of the invention include collapsible chairs which when collapsed may be carried as a backpack and which may also have a pack container in order to carry additional items. Particular embodiments include a collapsible chair frame which can be opened into a chair partially unfolded to provide a stand for the backpack or collapsed into a backpack frame. The collapsible chair frame may also have armrests for the further comfort and convenience of the chair user. The collapsible chair frame may also be positioned so that it forms a frame that supports the backpack in an integral upright position when being used as a backpack. A seat panel is attached to the collapsible chair frame in order to provide support for the user of the backpack chair. The seat panel may be composed of one piece of material or of multiple pieces.

A pack container may be attached to the seat panel. The pack container can be in the shape of a backpack and allow the user of the backpack chair to be able to carry items in the pack container when the collapsible chair frame is collapsed. Items stored in the pack container are easily accessible to a user when the collapsible chair frame is opened and the backpack chair is being used as a chair. The seat panel may also provide a back rest to separate the pack container from the user's back, both when the chair is collapsed and being worn as a backpack and also when the chair is open and being used as a chair. A flap is also attached to the seat panel directly above the pack container. The flap may be used to close off the top of the pack container in order to keep items from falling out of or into the pack container. The flap has a dual purpose in that it may also be used to provide shade for the user when the backpack chair is open into a chair.

Shoulder straps may be attached to the seat panel on the opposite side of the collapsed collapsible chair frame from the pack container. These shoulder straps allow the user to carry the chair and the pack container on their back as they walk or hike to their destination. Hollow cylinders of resilient members may be placed around certain areas of the collapsible chair frame in order to provide cushions for the user's comfort. Latches may be attached in order to keep the flap secured over the pack container and in order to keep the collapsible chair frame in a collapsed position. A handle may also be attached to the top of the backpack chair in order to allow the user to pickup the backpack chair and move it.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Figure 1:
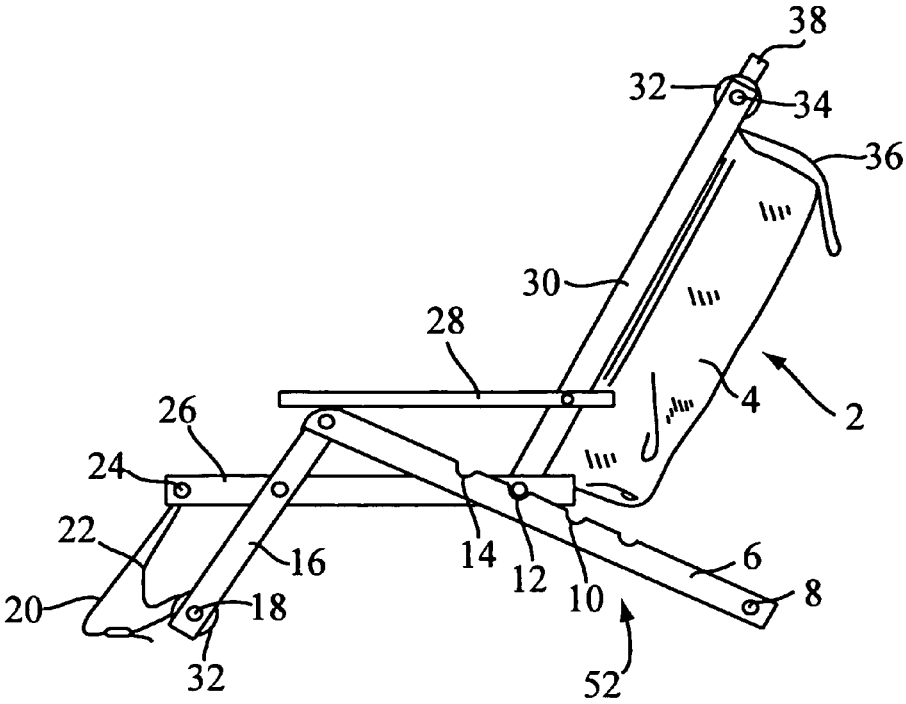
FIG. 1 is a side view of a backpack chair open into a chair configured according to an embodiment of the present invention.

An assembled backpack chair configured according to an embodiment of the present invention is shown in FIG. 1 where the unit is designated 2. It comprises a pack container 4 which may be formed of a pliant material, a collapsible chair frame generally designated 52, a pair of shoulder straps 20 and a flap 36 which covers the pack container 4 and may be used to provide shade when the backpack chair 2 is being used as a chair.

Figure 4:
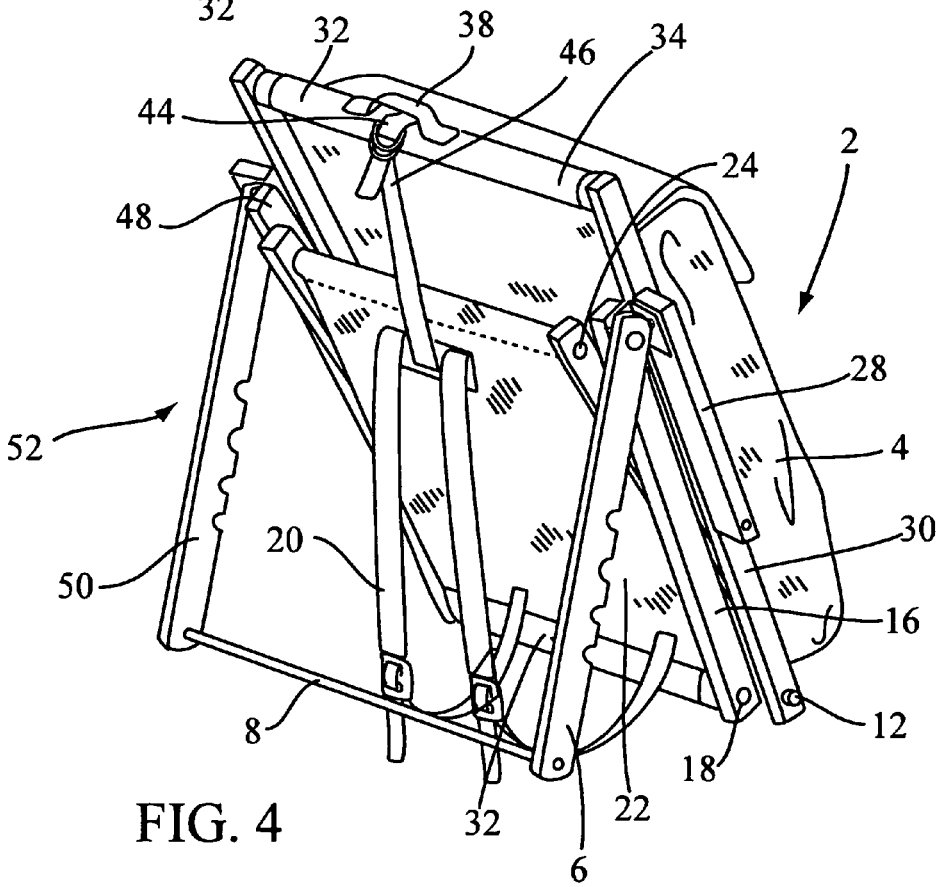
FIG. 4 is a perspective view of a backpack chair open into a stand to support a pack container configured according to an embodiment of the present invention.
Figure 5:
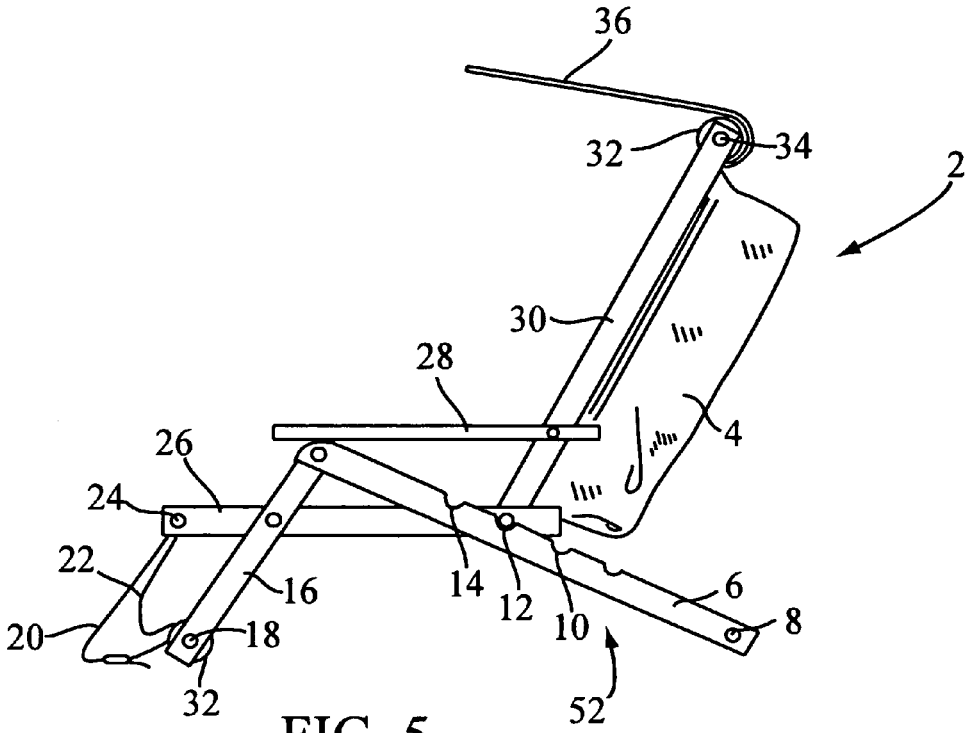
FIG. 5 is a side view of a backpack chair open into a chair with a flap providing shade configured according to an embodiment of the present invention.
Figure 6:
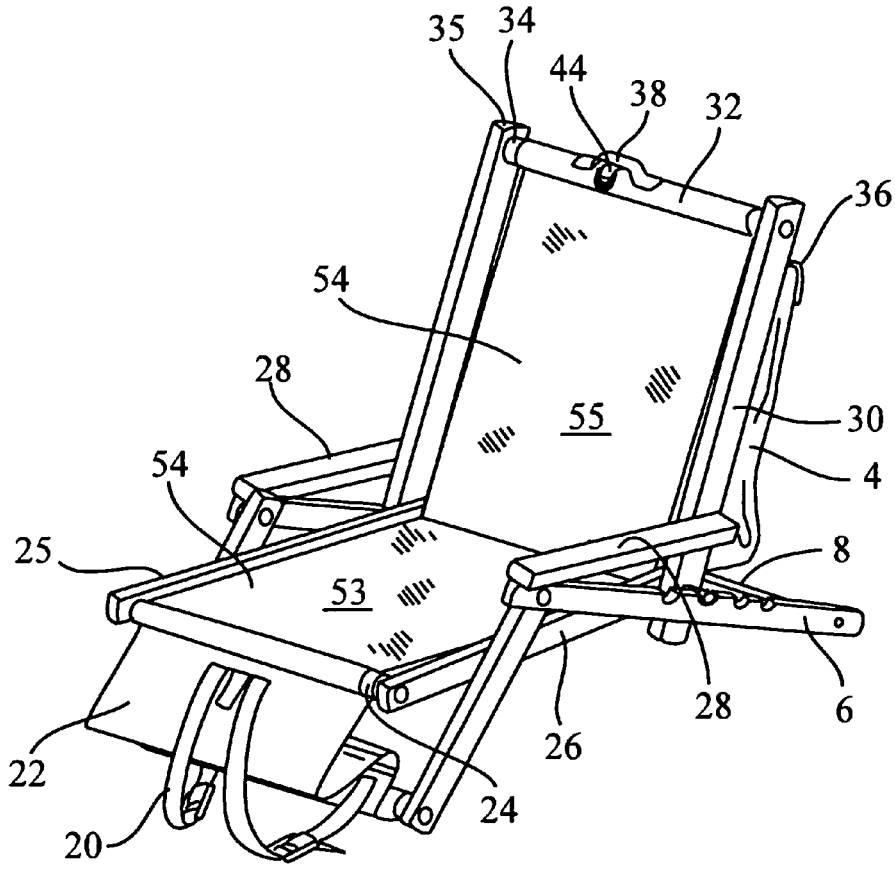
FIG. 6 is a perspective view of a backpack chair open into a chair configured according to an embodiment of the present invention.

As seen in FIGS. 1–6, the collapsible chair frame 52 collapses into a backpack frame and opens into a chair. The back of the chair is at a certain angle to the seat of the chair. This angle is adjustable. The collapsible chair frame 52 is formed from multiple frame members which are attached together in order to form U-shaped members. These U-shaped members provide the frame for the chair. The U-shaped members may then be rotatably attached together in order to form the collapsible chair frame 52. For instance, frame members 30, 34 and 35 (as shown in FIG. 6) are attached in a first U-shape. Frame member 30 is attached at one end of frame member 34, while member 35 is attached at the other end of frame member 34 thereby forming the frame for the top portion of seat panel 54. The same is true of members 26, 24 and 25 which form the frame for the bottom portion of seat panel 54. One end of the frame member 24 is secured to frame member 26 and the other end of the member 24 is secured to frame member 26. The second U-shape formed by 26, 24 and 25 is then rotatably attached at 12 to the U-shape formed by 30, 34 and 35. These two rotatably connected U-shapes form the frame for the seat itself. The first U-shape forms the back of the chair and the second U-shape forms the seat of the chair. The two U-shapes can also be rotated together in order to form part of the backpack frame.

Frame member 6 and member 8 also form a third U-shape with member 50. Member 6 is attached at one end of member 8 while the member 50 is attached at the other end of member 8 thereby forming the third U-shape. Member 16, member 18 and member 48 are also attached in order to form a fourth U-shape. This fourth U-shape is then rotatably connected to the third U-shape formed by members 6, 8 and 50. These two rotatably connected U-shapes form the supports or legs of the chair. When the collapsible chair frame 52 is collapsed, these U-shapes also help form a frame for a backpack. The rotatable connection 12 rests in slots 14 or 10 which have been cut into member 6. This allows member 6 to support the U-shapes formed by members 30 and 26. In other words, member 6 forms a leg of the chair frame.

The collapsible chair frame 52 may be made of most woods including, but not limited to, solid oak, or of light weight metal, plastic and the like. Any material may be used that is capable of supporting a user sitting on the chair.

Arm rests 28 may also be attached to the collapsible chair frame 52. The arm rests 28 help to make the chair more comfortable to sit in. They also help to hold the collapsible chair frame 52 in a chair position when the frame is open. The arm rest 28 is rotatably attached to member 30 and to the rotatable connection between member 6 and member 16.

The angle of the chair seat to the chair back is adjustable by simply moving the rotatable connection 12 to a different slot cut into member 6. For instance if the rotatable connection 12 is moved to slot 14 on member 6, the chair will be more horizontal. If rotatable connection 12 is then moved to slot 10, the chair will have more of a 90 degree angle allowing a user of the chair to sit upright instead of laying back. Multiple slots such as 10 and 14 may be cut in member 6 in order to allow the chair to be positioned at many different angles.

As shown in FIG. 4, the configuration of the collapsible chair frame 52 also allows the third U-shape formed by members 6, 8 and 50 to act as a stand for the backpack when the collapsible chair frame 52 is collapsed into a backpack frame. When the collapsible chair frame 52 is collapsed into a backpack frame, the third U-shape formed by members 6, 8 and 50 may be rotated away from the rest of the collapsible chair frame 52 in a direction opposite that which the U-Shape rotates during normal operation of the backpack chair 2 as a chair. In order for the U-Shape formed by members 6, 8 and 50 to rotate away from the rest of the collapsible chair frame 52, members 6 and 50 may need to extend beyond the rest of the collapsed chair frame 52. This extra length in members 6 and 50 allows the U-Shape formed by members 6, 8 and 50 to rotate around the rest of the chair frame 52 without interference. Extra space may also be needed at the rotatable connection between members 6, 16 and arm rest 28 and also at the connection between members 30, 50 and arm rest 28. Particularly, in order for the U-Shape formed by members 6, 8 and 50 to rotate away from the rest of the collapsible chair frame 52 and in the opposite direction than the U-Shape member rotates during the operation of the backpack chair 2 as a chair, there should be room allowed between member 6, 50 and arm rest 28 in order to allow member 6, 50 to rotate away from arm rest 28. This added room may be provided by mounting arm rest 28 on a bracket, the bracket being mounted to the rotatable connection between members 6 and 16 and to the rotatable connection between members 30 and 50. The bracket may distance arm rest 28 from member 6, 50 in order to allow member 6, 50 to rotate away from the rest of the collapsed chair frame 52. This third U-shape forms an angle with the rest of the collapsible chair frame 52 which is in the collapsed position. This angle allows the collapsible chair frame 52 to lean against the U-shape formed by members 6, 8 and 50, while keeping the backpack in the upright position for easy packing and unpacking.

As seen in FIGS. 1–6, a seat panel 54 is connected to the collapsible chair frame 52 in order to form a seat portion 53 and a back portion 55 for the chair. In one configuration, one side of the back portion 55 can support the user when sitting in the chair and the other side can serve as a wall of the backpack. The seat panel 54 can be one piece of flexible material or it may be formed of many separate pieces of flexible material. The seat panel 54 may be formed of any material that is flexible in order to provide comfort and strong enough to support a user sitting in the chair. The seat panel 54 may also be formed from UV resistant material in order to give the backpack chair 2 a long life in the sun.

While in one embodiment the backpack and chair are unitary and share a common panel formed by back portion 55, the backpack could also be removable. For example, the backpack could be a stand alone item which is removably securable to the back of the chair. This attachment could be affected by using a zipper, velcro, clasps or any other suitable means for removably securing the backpack in place. In such an embodiment, the user could leave the chair in place and still use the backpack to carry other items.

The seat panel 54 is connected to the collapsible chair frame 52 by attaching to member 34, rotatable connection 12, member 24 and member 18. The seat panel 54 may be attached to the collapsible chair frame by looping the member it is attached to, or by any other method that provides enough strength to support the weight of a user sitting on the chair. If the seat panel 54 is formed of many separate pieces, then each piece would start at one member and end at the next connection. For instance, one piece would be attached between member 34 and rotatable connection 12. The next piece would be attached between rotatable connection 12 and member 24 and the last piece would be attached between member 24 and 18. If however, one continuous piece of material is used for the seat panel 54, the seat panel 54 would weave in and out of the members and rotatable connections. For instance, the beginning of the seat panel 54 could be attached to cross member 34, the seat panel 54 would then travel under rotatable connection 12, over member 24 and be attached to member 18. If the seat panel 54 is formed from one continuous piece of material, the seat panel 54 may also be attached to each member that it crosses over.

The seat panel 54 also forms a back rest 22. The back rest 22 is formed by the seat panel 54 that is attached between members 24 and 18. The seat panel 54 is pulled tightly between these two members, forming a back rest 22 that separates the user's back from the pack container 4, when the backpack chair 2 is being used as a backpack. Particularly, items placed in the pack container 4 may make the pack container's 4 surface uneven and may when used as a backpack poke into the user's back causing discomfort. The back rest 22 is pulled tight so that it keeps the user's back from pushing up against the pack container 4 and prevents that discomfort. In order to form a tight back rest 22, it may be necessary to secure the seat panel 54 tightly to members 24 and 18.

A hollow cylinder of resilient material 32 may be placed around member 34. The hollow cylinder of resilient material 32 may provide a padded headrest when the collapsible chair frame 52 is open into a chair. The cylinder of resilient material 32 may be formed of any resilient material such as rubber or foam that would provide padding for the user. A second hollow cylinder of resilient material 32 may be placed around member 18. This cylinder of resilient material 32 provides padding for the user's back when the collapsible chair frame 52 is collapsed into a backpack frame. The cylinder of resilient material 32 will keep the frame from rubbing and bruising the user's back and will make the backpack chair more comfortable to carry. Like the other hollow cylinder of resilient material 32, this hollow cylinder of resilient material 32 can also be formed from any resilient material such as rubber or foam that would provide padding for the user. It is even possible that the hollow cylinder of resilient material 32 may be simply an inflatable cylinder surrounding the member. The inflatable cylinder could be inflated or deflated as desired. Hollow cylinders of resilient material 32 may be placed anywhere on the collapsible chair frame 52 where padding is desired.

A pack container 4 is attached to the section of seat panel which forms the chair back. The pack container 4 is an open backpack. It holds anything that the user of the backpack chair wishes to carry with them. The pack container 4 may be as large as possible to maximize the space available to carry items. This pack container 4 may be formed from any type of material, including the same type of material used for the seat panel.

A flap 36 covers the top of the pack container 4. The flap 36 is meant to keep things from falling out of or into the pack container 4. The flap 36 is also configured to provide shade when the backpack chair 2 is open into a chair. This is accomplished by flipping the flap 36 over member 34 in order to shade the chair as shown in FIG. 5. The flap 36 may be of any suitable length and may be longer than half the length of the pack container 4 in order to provide a larger shade. The flap 36 may also have some type of stiffener such as stays which run along the edges of the flap 36, making the flap 36 stiff enough to hold the position it is set in so as to shade the chair as desired. It should also be appreciated that the flap 36 could be configured with foldout sections (not shown) to increase the size of the flap 36 when it is being used as a shade. These foldout sections could extend outwardly from the flap or could be configured to hang down from the flap 36 when used as a shade.

Figure 2:
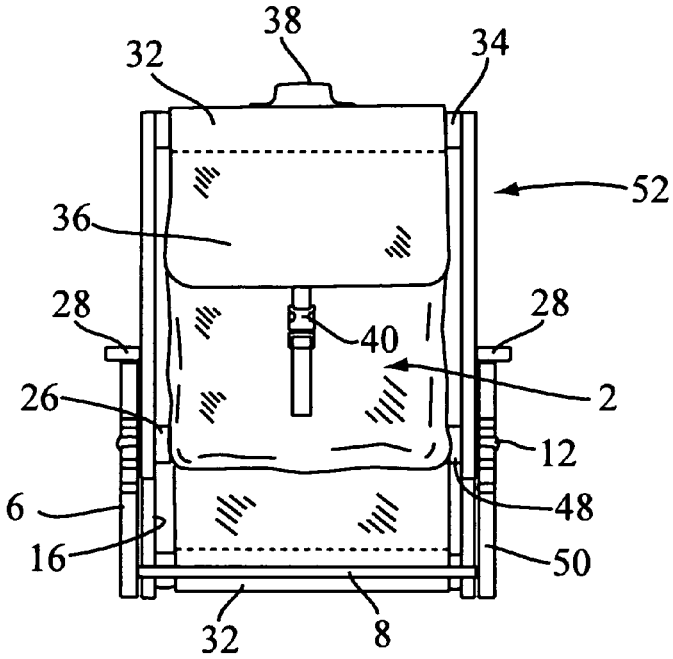
FIG. 2 is a back view of a backpack chair open into a chair configured according to an embodiment of the present invention.

As shown in FIG. 2, the flap 36 may also have a latch 40 which secures the flap 36 to the pack container. The latch 40 may be any type of connector that can be connected and disconnected, such as a quick release buckle. One end of the latch 40 should be attached to the flap 36 while the other end should be attached to the pack container. It is also possible that multiple latches could be used to secure the flap 36 in place over the pack container. One half of the latches may be placed on the sides of the flap 36. The second half of these latches would be attached to the backpack frame itself. When the latches are connected, the flap would be secured in place over the pack container provided the pack container was full enough or stiff enough not to sag.

Figure 3:
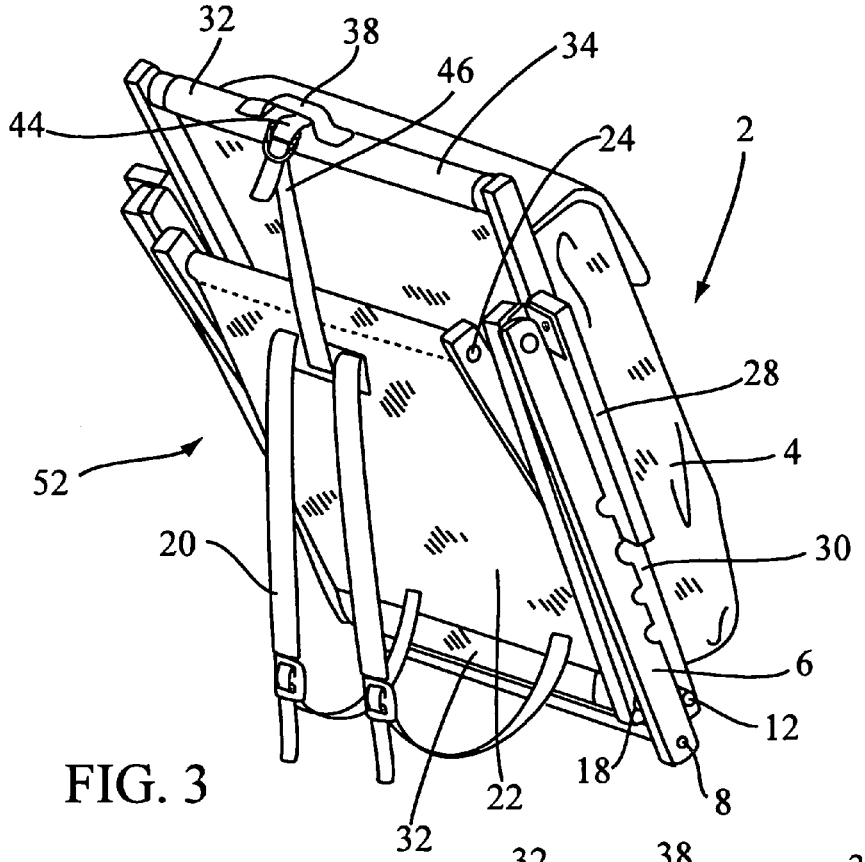
FIG. 3 is a perspective view of a backpack chair configured according to an embodiment of the present invention.

A second latch is seen in FIG. 3. This latch 44 and 46 is used to secure the collapsible chair frame 52 in the collapsed position. This latch 44 and 46 prevents the collapsible chair frame 52 from falling open while the backpack chair is being used as a backpack. Like the previous latch, this latch 44 and 46 may be any type of connector that can be connected and disconnected but that has enough strength to hold the collapsible chair frame 52 collapsed. One example of a latch is a nylon webbing strap woven through D rings in order to secure the collapsible chair frame 52 in the collapsed position. Half of this latch 44 would be connected to one end of the collapsible chair frame 52 at the point that a continuous seat panel would begin. The second half of this latch 46 would be connected to the collapsible chair frame 52 at the point that the continuous seat panel would end. By connecting these two latches, the collapsible chair frame will be held in a collapsed position.

FIG. 3 is an embodiment of the present invention which illustrates that shoulder straps 20 may be attached to the backpack chair 2. The shoulder straps 20 are attached directly opposite the pack container 4 as positioned when the collapsible chair frame 52 is in the collapsed position. These shoulder straps 20 allow a user to wear the backpack chair 2 on their shoulders like a backpack. The shoulder straps 20 should be strong enough to support the load of the backpack chair 2 and anything that could be placed in the pack container 4. The shoulder straps 20 may also be adjustable in order to provide comfort and ease of use. The shoulder straps 20 may also be padded in order to provide comfort.

A handle 38 may be attached above the pack container in order to allow the backpack chair 2 to be moved easily, particularly when the collapsible chair frame 52 is in the collapsed position. The handle 38 may be attached anywhere on the backpack chair 2 which would provide aid in moving the backpack chair 2. Multiple handles may even be attached to the backpack chair 2. For instance, a handle may be attached to the top of the backpack chair 2 and to the side of the backpack chair 2 so that a user may carry the backpack chair 2 in whichever way is most convenient. The handle 38 may be formed of any material that has the strength to support the backpack chair 2 and anything that may be placed in the pack container. The handle 38 may also be padded for comfort and should be big enough for most size hands to fit in comfortably.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. A backpack chair unit comprising:

a collapsible chair frame wherein the frame opens into a chair and collapses into a backpack frame;

at least one seat panel attached to the collapsible chair frame;

a pack container having at least one opening, said pack container attached to the chair;

a pair of shoulder straps attached to the chair so that the pair of shoulder straps are directly opposite the pack container when the collapsible chair frame is collapsed; and a pack container flap having at least two stays coupled to edges of the flap, the flap being moveable between a closed position wherein the flap covers at least one opening of the pack container, and an extended position wherein the flap is rotated over a portion of the frame and each stay has sufficient stiffness and holds the position it is set in while extending the flap over the chair, the stays maintaining the flap over the chair in a self-sustained, substantially horizontal position to provide shade over the chair when the collapsible chair frame is open.

2. The backpack chair unit of claim 1, wherein the collapsible chair frame is configured to partially open into a stand which supports the pack container upright without opening the collapsible chair frame fully.

3. The backpack chair unit of claim 1, further comprising hollow cylinders of resilient material which surround the collapsible chair frame at least one place where the at least one seat panel attaches to the collapsible chair frame.

4. The backpack chair unit of claim 3, further comprising at least one arm rest attached to the collapsible chair frame.

5. The backpack chair unit of claim 4, further comprising a latch for securing the collapsible chair frame in a collapsed position.

6. The backpack chair unit of claim 1, further comprising a latch for securing the flap in the closed position over the pack container.

7. A backpack chair unit comprising:

a collapsible chair frame which opens into a chair at an angle and collapses into a backpack frame wherein the collapsible chair frame further comprises at least one U-shaped member;

at least one seat panel attached to the collapsible chair frame;

a pack container attached to one of the at least one seat panels, wherein one of the at least one U-shaped members is configured to rotate away from the collapsible chair frame to provide a stand to support the pack container without the collapsible chair frame being opened into a chair;

a pair of shoulder straps attached to one of the at least one seat panels so that the pair of shoulder straps are opposite the pack container when the collapsible chair frame is collapsed; and a flap for covering the top of the pack container wherein the flat includes at least two stays and is rotatable over a portion of the frame and each stay has sufficient stiffness and holds the position it is set in while extending the flap over the chair the stays maintaining the flap over the chair in a self-sustained, substantially horizontal position to provide shade when the collapsible chair frame is open.

8. The backpack chair unit of claim 7, further comprising a latch for securing the flap over the pack container.

9. The backpack chair unit of claim 7, wherein the angle of the collapsible chair frame is adjustable when the frame is opened into a chair.

10. The backpack chair unit of claim 7, further comprising at least one arm rest attached to the collapsible chair frame.

11. The backpack chair unit of claim 7, further comprising a latch for securing the collapsible chair frame in a collapsed position.

12. A backpack chair comprising:

a collapsible chair frame wherein the collapsible chair frame opens to form a chair at an angle and collapses to form a backpack frame;

at least one seat panel attached to the collapsible chair frame;

a pack container attached to the at least one seat panel, wherein the collapsible chair frame is configured to open partially to form a stand for the pack container;

a pair of shoulder straps attached to the at least one seat panel, wherein the shoulder straps are positioned opposite the pack container when the collapsible chair frame is in the collapsed position; and a flap for covering the pack container having at least two stays coupled to edges of the flap, wherein the flap is rotatable over a portion of the frame and each stay has sufficient stiffness to hold the position it is set in while extending the flap over the chair, the stays maintaining the flap over the chair in a self-sustained, substantially horizontal position to provide shade over the chair when the collapsible chair frame is open.

13. The backpack chair of claim 12, further comprising a latch for securing the flap over the pack container.

14. The backpack chair of claim 12, further comprising hollow cylinders of resilient rubber which surround the collapsible chair frame where at least one of the at least one seat panel attaches to the collapsible chair frame.

15. The backpack chair of claim 12, further comprising a latch for securing the collapsible chair frame in the collapsed position.

16. The backpack chair of claim 12, wherein the collapsible chair frame is comprised of at least two U-shaped members rotatably connected.

17. The backpack chair of claim 12, further comprising a handle attached to the backpack chair for moving the backpack chair when the collapsible chair frame is in the collapsed position.

18. The backpack chair of claim 12, wherein the collapsible chair frame has at least one arm rest attached.

19. The backpack chair of claim 12, wherein the angle of the chair is adjustable when the collapsible chair frame is in the open position.

* * * * *

UNITED STATES PATENT AND TRADEMARK OFFICE

CERTIFICATE OF CORRECTION

PATENT NO. : 7,118,172 B1
APPLICATION NO. : 11/010065
DATED : October 10, 2006
INVENTOR(S) : Pattison-Sheets It is certified that error appears in the above-identified patent and that said Letters Patent is hereby corrected as shown below:

In Claim 7, Col 8 line 51, the following should read as follows: -- the flap includes at least two stays and is rotatable over--

Signed and Sealed this

Twelfth Day of December, 2006

JON W. DUDAS
*Director of the United States Patent and Trademark Office*